US006378310B1

(12) United States Patent
Le Gal et al.

(10) Patent No.: US 6,378,310 B1
(45) **Date of Patent: *Apr. 30, 2002**

(54) COMBUSTION CHAMBER OF A GAS TURBINE WORKING ON LIQUID FUEL

(75) Inventors: Jean-Hervé Le Gal, Paris; Patrick Flament, Auffargis; Gérard Martin, St Genis-Laval; Guy Grienche, Coarraze; Gérard Schott, Rontignon, all of (FR)

(73) Assignee: Institut Francais du Petrole, Rueil-Malmaison cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/238,586

(22) Filed: Jan. 28, 1999

(30) Foreign Application Priority Data

Jan. 28, 1998 (FR) ..... 98 00932

(51) Int. Cl.[7] ..... F02C 1/00; F02G 3/00
(52) U.S. Cl. ..... 60/760; 60/740; 60/748
(58) Field of Search ..... 60/740, 748, 760

(56) References Cited

U.S. PATENT DOCUMENTS

| | | | | |
|---|---|---|---|---|
| 2,638,745 A | * | 5/1953 | Nathan | 60/748 |
| 3,735,930 A | * | 5/1973 | Mori | 60/740 X |
| 4,006,589 A | | 2/1977 | Schirmer | |
| 4,222,232 A | * | 9/1980 | Robinson | 60/748 X |
| 4,271,675 A | * | 6/1981 | Jones et al. | 60/737 |
| 4,702,073 A | | 10/1987 | Melconian | |
| 4,842,509 A | | 6/1989 | Hasenack | |
| 4,928,481 A | * | 5/1990 | Joshi et al. | 60/748 X |
| 5,479,781 A | * | 1/1996 | Fric et al. | 60/740 |
| 5,488,829 A | * | 2/1996 | Southall et al. | 60/725 |
| 5,562,437 A | | 10/1996 | Gauthier et al. | |
| 5,680,766 A | | 10/1997 | Joshi | |
| 5,974,780 A | * | 11/1999 | Santos | 60/39.05 |

FOREIGN PATENT DOCUMENTS

| | | |
|---|---|---|
| GB | 387049 | 2/1933 |
| GB | 870988 | 6/1961 |

* cited by examiner

*Primary Examiner*—Charles G. Freay
*Assistant Examiner*—Timothy P. Solak
(74) *Attorney, Agent, or Firm*—Antonelli, Terry, Stout & kraus, LLP

(57) ABSTRACT

A combustion chamber of a gas turbine working on liquid fuel includes a tubular enclosure (2) having at least one pressurized air inlet, a liquid fuel injection means (6) positioned on or in proximity to the longitudinal axis (XX') of the tubular enclosure, and an outlet to the turbine. The fuel injection means (6) includes a series of orifices (62) arranged so as to create separate fuel jets, the jets being arranged in the direction of the generatrices of a cone with an angle ranging between 30° and 60° at the vertex thereof. The chamber includes at least two types of pressurized air inlets placed close to each other, the first one (7) taking in the air helically around the longitudinal axis of the combustion chamber, the second air inlet (8) being tangential to enclosure (2) so as to create, around the fuel jets, counter-rotating flows intended to improve mixing of the air and of said fuel. The assembly preferably works at a pressure ranging between 2 and 30 bars and with a fuel/air ratio ranging between 0.4 and 0.8.

10 Claims, 2 Drawing Sheets

FIG.1
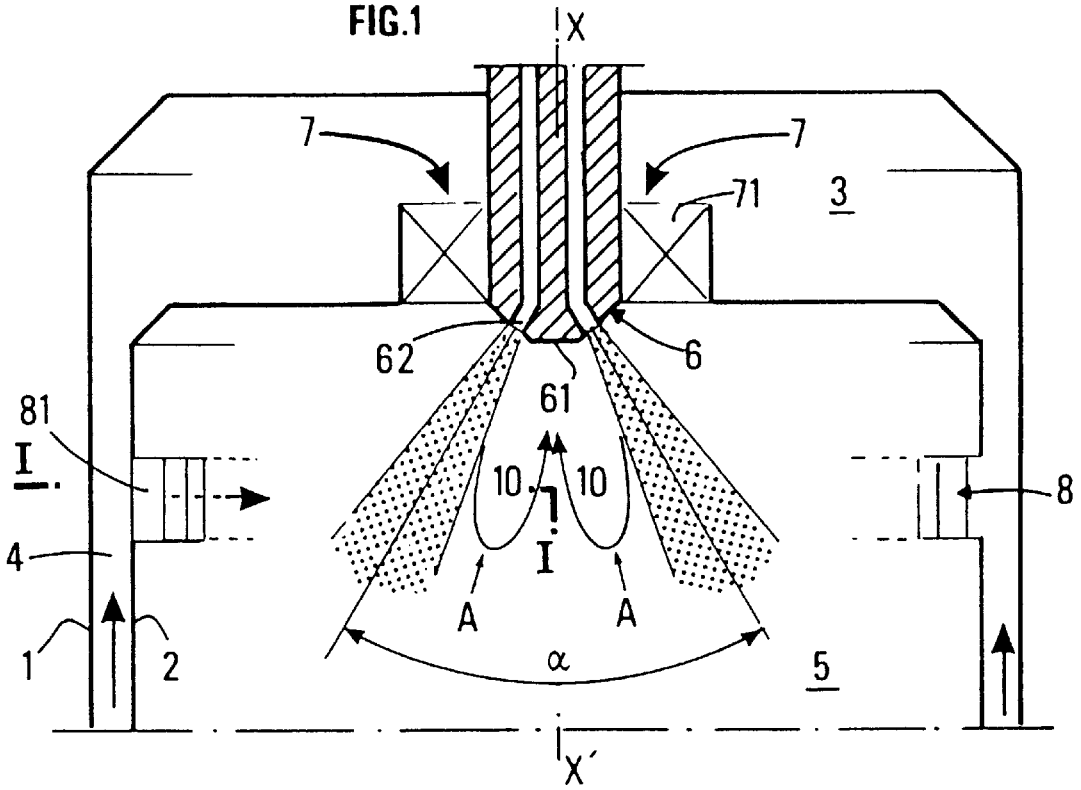
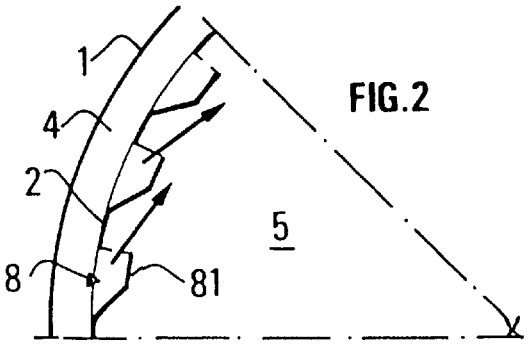
FIG.2

COMBUSTION CHAMBER OF A GAS TURBINE WORKING ON LIQUID FUEL

FIELD OF THE INVENTION

The present invention relates to the field of combustion chambers of gas turbines working on liquid fuel.

Such gas turbines can be illustrated by the system shown in FIG. 3. This assembly comprises a compressor (20) whose outlet is connected to the inlet of combustion chamber (1) where a liquid fuel (fuel-oil or kerosine) is injected. The gases burnt in this chamber are then expanded in a turbine (30) which thus supplies the desired power to the main shaft driving compressor (20).

BACKGROUND OF THE INVENTION

It is well-known that combustion in this type of gas turbines leads to the formation of nitrogen oxides of various origins:

"prompt" NO results from complex fast reactions between the fuel and the nitrogen of the air. It forms in a very short space of time generally much less than one millisecond, "fuel" NO is produced by reactions between the nitrogen contained in the fuel in N form and the oxygen of the air. This type of nitrogen oxide is mainly formed in a lean medium when the air is in excess in relation to the fuel, thermal nitrogen oxide is produced at high temperature from the nitrogen of the air $N_2$. Nitrogen oxide is commonly produced at temperatures above 1500° C., in view of the residence times in the combustion chamber, which is then of the order of a few ten milliseconds. The rate of the reactions leading to thermal nitrogen increases exponentially as a function of the temperature.

It is the last-mentioned type of nitrogen that poses problems, as explained hereafter.

In the combustion chambers of gas turbines, combustion at the level of the flame is generally achieved around stoichiometry as this provides good flame stability. However, the global fuel/air ratio imposed by the conditions of the thermodynamic cycle of the machine is very low, of the order of 0.15 to 0.3, according to the operating conditions. Local operation under rich conditions or around stoichiometry, with air preheated by the compressor, locally leads to very high temperatures in the chamber (of the order of 2000 to 2500 K). Measurements show that, under such conditions, most of the nitrogen oxide formed is <<thermal NO >>.

Several solutions are known to decrease nitrogen oxides emissions. They can globally be divided into two main types:

wet processes based on injection of steam or water in the combustion chamber, dry processes based on an improvement of the combustion conditions.

Wet processes give rather satisfactory results from the technical point of view, but they are often more complex and more difficult to implement than dry processes.

Furthermore, they are more expensive than dry processes because of the steam that is necessarily injected either in the liquid or in the gas phase.

Dry processes are generally aimed at achieving combustion of a previously obtained lean premix of air and fuel. Patent application Ser. No. EP-A2-0,769,657 illustrates a system of this type. Combustion stability and ignition of the main premix are provided by a low-power pilot flame whose purpose is also to ensure operation of the machine at idle speed. The mixture strength in the chamber being determined by the respective proportions of premixed air and fuel, it is possible to limit the flame temperatures and therefore the thermal nitrogen oxide.

This technology can be implemented quite easily with a gaseous fuel. In case of a liquid fuel, the problem is more complex since it requires vaporization prior to mixing it with air. Evaporation can be achieved by evaporating a liquid film on a hot wall or by injecting the fuel in spray form in a pipe where it mixes with the air: this is the case of the aforementioned European document.

Current combustion technologies using premixing give no satisfactory results with liquid fuel. Furthermore, this technique requires a pilot burner allowing to ensure flame stability, notably under lean conditions. This burner ensuring operation of the machine during idling phases, a flow of fuel that can reach almost a third of the total flow passes therethrough. For certain applications, it works under operating conditions close to stoichiometry, therefore under unfavourable operating conditions from the viewpoint of nitrogen oxides production.

The present invention allows to solve notably all the above-mentioned problems. It is an alternative solution to combustion chambers using premixing or to wet processes as mentioned above.

The present invention is aimed at achieving a diffusion flame by combining certain air and liquid fuel injection conditions.

There are already diffusion flames in other technical fields than that of the combustion chambers of gas turbines. Boiler burners such as those described for example in patent FR-2,656,676 allow to create diffusion flames. Similarly, patent U.S. Pat. No. 5,562,437 discloses this type of structure fitted to a boiler burner however.

Nevertheless, in this type of combustion, the operating conditions are fundamentally different.

The mixtures are much richer in burners than in turbines. Burners operate around stoichiometry or with a slight excess of air, whereas the global mixture strength in turbine chambers usually ranges between 0.15 and 0.35, Combustion is performed under pressure (that of the compressor outlet), whereas burners work at atmospheric pressure, Besides, the heat densities are considerably higher in the combustion chambers of turbines, commonly several ten times as high.

There are also well-known elementary flame techniques in the field of oilwell testing burners. Here again, the operating conditions are very different, notably the pressure which is here the atmospheric pressure. French patent application FR-2,741,424 describes a burner of this type.

These different operating conditions impose constraints and therefore specific structures suited to these particular functions.

SUMMARY OF THE INVENTION

The object of the present invention is a combustion chamber of a gas turbine working on liquid fuel, comprising a tubular enclosure having at least one air inlet, a liquid fuel injection means positioned on or in proximity to the longitudinal axis of the tubular enclosure, an outlet to the turbine, at least two types of pressurized air inlets placed close to each other: the first one taking in the air helically around the longitudinal axis of the combustion chamber, the second inlet taking in the air tangentially to the enclosure in order to create, around the fuel jets, counterrotating flows intended to improve mixing of said fuel and air.

According to the invention:

Said fuel injection means comprises a series of orifices arranged so as to create separate fuel jets, said jets being arranged in the direction of the generatrices of a cone with an angle ranging between 30° and 60° at the vertex thereof, the assembly working at a pressure ranging between 2 and 30 bars and with a fuel/air ratio ranging between about 0.4 and about 0.8, and the residence time of the fluids in the enclosure is less than 50 milliseconds.

In particular, the first air inlet allows to introduce 30% to 70% of the total amount of pressurized air entering the combustion chamber, the rest being injected through the second pressurized air inlets.

According to the invention, said injection means has 5 to 12 orifices intended for injection of the liquid fuel, and preferably 6 to 10 orifices.

Besides, the air inlets and the injection means are so positioned that the swirl ratio N ranges between 0.2 and 0.4, N being defined by: where:

$R_1$ and $R_2$ are respectively the inner radius and the outer radius of air inlet (7), expressed in meters, $\rho$ is the density of the air in $kg/m^3$, Vax is the axial velocity of the fluid at the outlet of inlet (7), $V_{tg}$ is the tangential velocity of the fluid at the outlet of inlet (7), the velocities being expressed in m/s.

According to a particular feature of the invention, the injection means comprises a central disk positioned on the longitudinal axis of the tubular enclosure, around which a ring pierced with said orifices is arranged, the surface of the ring being a truncated cone.

Specifically, the tangential inlet comprises a series of inserts distributed on the periphery of the enclosure, which leads the air tangentially to the wall of the enclosure in the opposite direction to the direction of rotation of the main flow.

The air inlets can be so dimensioned that the velocity of the air in the combustion chamber ranges between 20 and 120 m/s.

Besides, the angle at the vertex of the injection cone preferably ranges between 35° and 45°.

BRIEF DESCRIPTION OF THE DRAWINGS

Other features, details and advantages of the invention will be clear from reading the description hereafter, given by way of non limitative example, with reference to the accompanying drawings wherein:

FIG. 1 is a simplified longitudinal section of a combustion chamber according to the invention, FIG. 2 is a schematic section of a detail of the invention according to FIG. 1.

DETAILED DESCRIPTION OF THE INVENTION

Figure 3:
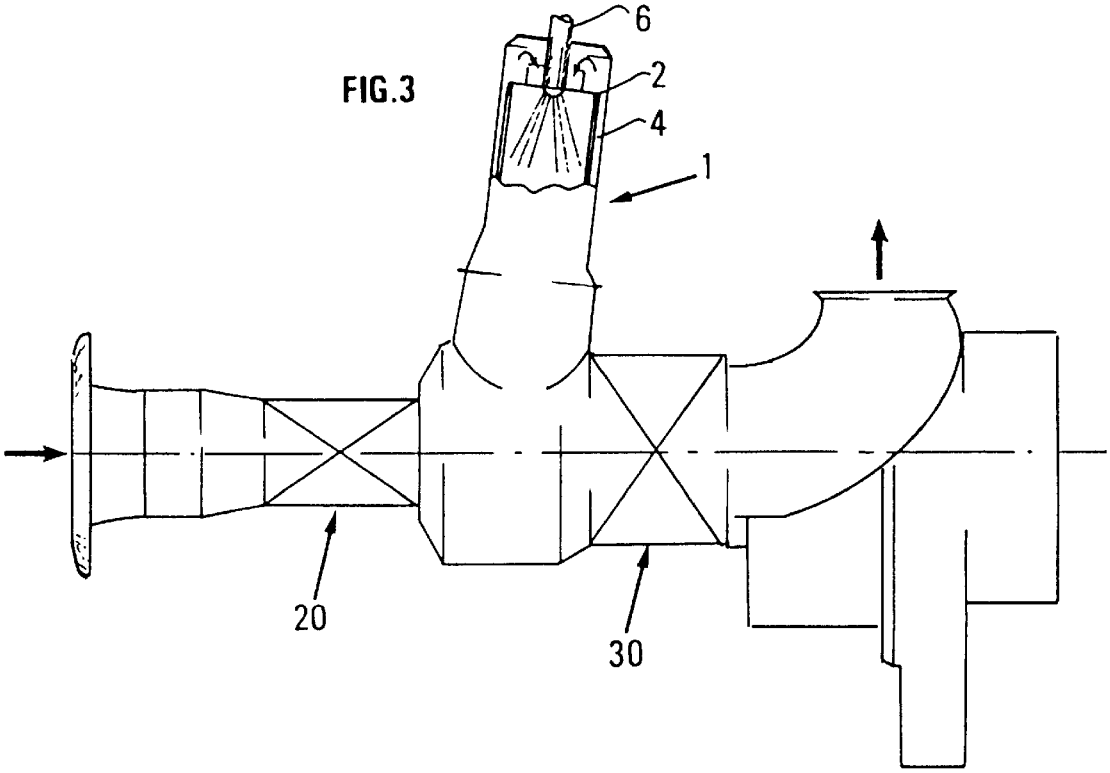
FIG. 3 is a simplified longitudinal section of a turbocompressor implementing the invention.

The combustion chamber according to the invention, diagrammatically illustrated by FIG. 1, comprises a tubular outer housing 1 and an inner enclosure 2 coaxial to housing 1.

Both casings are closed at one end where they delimit a functional space 3. Furthermore, casings 1 and 2 define with each other an annular space 4 for circulation of the pressurized air before it enters the combustion chamber proper.

The combustion chamber proper, 5, is defined by the inner volume of enclosure 2.

The bottom of chamber 5 includes a fuel injection means 6 that preferably comprises a central disk 61 positioned on or in immediate proximity to the longitudinal axis XX' of enclosure 2. Furthermore, injection means 6 comprises a series of orifices 62 situated on a truncated ring. 5 to 12 jets can advantageously be created, and preferably 6 to 10. These jets are separate from one another and situated along the generatrices of a cone with an angle $\alpha$ ranging between 30° and 60°, preferably between 35° and 45°, at the vertex thereof.

Injection means 6 can work with additional air assistance. Droplets with an average diameter less than 50 micrometers are then obtained.

A separate-jet flame is of interest in many respects. This flame does not behave like several independent axial flames. First there are thermal type interactions between the various jets with a change in the flows between the jets and therefore in the local stoichiometric conditions. These conditions depend of course on the angle existing between the jets.

The smaller this angle is, the more the flame is close to an axial diffusion flame, whose performances from the viewpoint of Nox emissions are known to be bad since the fuel mixes poorly with the air.

If the angle increases too much, there is a risk that droplets will be projected along the walls, which may result in the formation of coke or formation of unburned products and of CO in cases where the walls are cooled and the temperatures are therefore low.

The number of jets is also important. If it is too large, a flow blocking effect due to the fuel jets is observed. An air-depleted zone is consequently created behind the jets, which leads to rich combustion conditions, therefore at high temperature. If the number of jets is too small, the interactions between jets decrease and one eventually has n independent axial flames.

Furthermore, two types of pressurized air inlets are provided, both positioned near functional space 3, and neither connected to a source of liquid fuel.

The first type takes in the air helically in enclosure 2, around the longitudinal axis of the enclosure. In this example, the inlet 7 is a ring around injection means 6. The air is referred to as "swirled axial air". Inclined blades 71 can be placed in the ring in order to impart a tangential momentum to this air.

The second air inlet type comprises peripheral inlets 8 which allow to inject the air tangentially to the wall of enclosure 2. Inserts 81 such as those shown in FIG. 2 can therefore be provided.

Inserts 81 lead the air tangentially and in the opposite direction to the first type of flow. This allows to increase shearing between the two flows and therefore to accelerate mixing between the air and the fuel droplets.

In order to obtain a stable flame under good mixture strength conditions, the flow of air at the level of inlet 7 ranges between 30 and 70% of the air serving for combustion, preferably between 40 and 50%. Of course, the flow of air passing through tangential inlets 8 is the 100% complement. Dilution air is introduced, if necessary, downstream from combustion zone 5 through orifices provided in enclosure 2.

Concerning the stability of the combustion flame, injection means 6 advantageously comprises a central disk 61. It allows, in combination with the rotating movement of the flow, to generate a short internal recirculation in the direction shown by arrows A in FIG. 1, near the nozzle of injector 6. Zone 10 delimited by this recirculation is rather rich in fuel and ensures part of the combustion stability. However, as mentioned above, most of the fuel is burnt under lean conditions since the global mixture strength in combustion chamber 5 ranges between 0.4 and 0.8. It may be reminded that a separate flame burner operates around stoichiometry or with a slight excess of air.

Air inlets 7, 8 and injection means 6 are so positioned that the swirl ratio N preferably ranges between 0.2 and 0.4. Swirl ratio N is defined by:
where:

$$N = \frac{\int_{R_1}^{R_2} Vax\rho V_{tg} 2\pi r dr}{\int_{R_1}^{R_2} Vax\rho Vax 2\pi r dr}$$

$R_1$ and $R_2$ are respectively the inner radius and the outer radius of air inlet (7), expressed in meters, ρ is the density of the air in kg/m$^3$, Vax is the axial velocity of the fluid at the outlet of inlet (7), $V_{tg}$ is the tangential velocity of the fluid at the outlet of inlet (7); the velocities are expressed in m/s.

Combustion chamber 5 according to the invention being suited to work with a turbine, the thermodynamic cycle thereof imposes operation at a pressure that can range from about 2 to about 30 bars.

In relation to a burner operating at atmospheric pressure, this modifies the density of the air and therefore the ratio of the densities between the air and the fuel, a ratio that can be multiplied by ten. The mixing and evaporation conditions are therefore notably different.

Furthermore, the residence times in combustion chamber 5 according to the invention are commonly less than 50 milliseconds, which leads to heat densities ranging between 50 and 200 MW/m$^3$.

By way of comparison, heat densities in the field of boiler burners are rather less than 1 MW/m$^3$, with residence times of the order of one second.

The particular operating conditions of the present invention lead to air velocities ranging between 20 and 120 m/s, given the dimensions of the first and of the second air inlet.

In order to better illustrate a preferred application of the invention, FIG. 3 shows in longitudinal section a turbocompressor that can implement the invention; this figure is commented on at the beginning of the description.

What is claimed is:

1. A combustion chamber of a gas turbine working on liquid fuel, comprising a tubular enclosure (2) having at least one air inlet, a liquid fuel injection means (6) producing fuel jets and being positioned on or in proximity to the longitudinal axis (XX') of the tubular enclosure, an outlet to the turbine, a first pressurized air inlet (7) connected to a source of pressurized air and not being connected to a source of liquid fuel and taking in the air helically around the longitudinal axis of the combustion chamber, a second pressurized air inlet (8) connected to a source of pressurized air and not being connected to a source of liquid fuel and taking in the air tangentially to enclosure (2) so as to create, around the fuel jets, counterrotating flows intended to improve mixing of the air and of said fuel, wherein said fuel injection means (6) comprises a series of orifices arranged so as to create separate fuel jets, said jets being positioned along the generatrices of a cone with an angle ranging between 30° and 60° at the vertex thereof, in that the assembly operates at a pressure ranging between 2 and 30 bars and with a global mixture strength ranging between about 0.4 and 0.8, and in that the residence time of the fluids in enclosure (2) is less than 50 milliseconds.

2. A combustion chamber as claimed in claim 1, characterized in that first air inlet (7) allows to introduce 30% to 70% of the total amount of pressurized air used for combustion, the rest being injected through second pressurized air inlets (8).

3. A combustion chamber as claimed in claim 1, characterized in that said injection means (6) has 5 to 12 orifices (62) intended for injection of the liquid fuel.

4. A combustion chamber as claimed in claim 1, characterized in that air inlets (7, 8) and injection means (6) are so positioned that swirl ratio N ranges between 0.2 and 0.4, N being defined by:
where:

$$N = \frac{\int_{R_1}^{R_2} Vax\rho V_{tg} 2\pi r dr}{\int_{R_1}^{R_2} Vax\rho Vax 2\pi r dr}$$

$R_1$ and $R_2$ are respectively the inner radius and the outer radius of air inlet (7), expressed in meters, ρ is the density of the air in kg/m$^3$, Vax is the axial velocity of the fluid at the outlet of inlet (7), $V_{tg}$ is the tangential velocity of the fluid at the outlet of inlet (7), the velocities being expressed in m/s.

5. A combustion chamber as claimed in claim 3, characterized in that injection means (6) comprises a central disk (61) positioned on the longitudinal axis XX' of the tubular enclosure, around which a ring pierced with said orifices (62) is arranged, the surface of the ring being a truncated cone.

6. A combustion chamber as claimed in claim 1, characterized in that said second pressurized air inlet (8) comprises a series of inserts distributed on the periphery of the enclosure (2), which lead the air tangentially to the wall of the enclosure (2), in the opposite direction of rotation to the direction of flow from the first pressurized air inlet (7).

7. A combustion chamber as claimed in claim 1, characterized in that the air inlets are so dimensioned that the velocity of the air in the combustion chamber ranges between 20 and 120 m/s.

8. A combustion chamber as claimed in claim 1, characterized in that the angle at the vertex of the injection cone ranges between 35° and 45°.

9. A combustion chamber as claimed in claim 1, characterized in that said injection means (6) has 6 to 10 orifices (62) intended for injection of the liquid fuel.

10. A combustion chamber as claimed in claim 9, characterized in that injection means (6) comprises a central disk (61) positioned on the longitudinal axis XX' of the tubular enclosure, around which a ring pierced with said orifices (62) is arranged, the surface of the ring being a truncated cone.

* * * * *